US005110062A

United States Patent [19]

Kremar

[11] Patent Number: 5,110,062

[45] Date of Patent: May 5, 1992

[54] DETECTION APPARATUS FOR PAPER BUILD UP ON REEL BAR

[75] Inventor: Djuro Kremar, Quebec, Canada

[73] Assignee: Valmet-Dominion Inc., Lachine, Canada

[21] Appl. No.: 551,832

[22] Filed: Jul. 12, 1990

[30] Foreign Application Priority Data

May 31, 1990 [CA] Canada ..... 2016013

[51] Int. Cl.[5] ..... B65H 75/00

[52] U.S. Cl. ..... 242/57

[58] Field of Search ..... 242/57, 57.1, 56 R, 242/78.8

[56] References Cited

U.S. PATENT DOCUMENTS

| | | | |
|---|---|---|---|
| 3,386,675 | 6/1968 | Thomsen | 242/55.13 |
| 3,845,320 | 10/1974 | Winberg | 242/57 X |
| 3,857,525 | 12/1974 | Gerber et al. | 242/57.1 |
| 3,883,086 | 5/1975 | Zagenfeird et al. | 242/57 X |
| 4,131,206 | 7/1977 | Kawada et al. | 214/1 BB |
| 4,171,106 | 3/1978 | Crouse | 242/66 |
| 4,267,752 | 2/1980 | Byrt et al. | 83/74 |
| 4,358,066 | 11/1982 | Deutschle | 242/68.4 |
| 4,445,646 | 5/1984 | Karr et al. | 242/56 R |
| 4,695,004 | 9/1987 | Grossmann et al. | 242/56 R |
| 4,744,720 | 5/1988 | Kremar | 414/748 |
| 4,762,292 | 8/1988 | D'Anci | 242/184 |
| 4,770,361 | 9/1988 | Maeda | 242/57 X |
| 4,794,475 | 12/1988 | Kosugi et al. | 242/57 X |
| 4,852,820 | 8/1989 | Looser | 242/56 R |
| 4,856,692 | 8/1989 | Harper | 242/57 X |

FOREIGN PATENT DOCUMENTS

| | | | |
|---|---|---|---|
| 59-47021 | 3/1984 | Japan | 242/57 |
| 2-38253 | 2/1990 | Japan | 242/57 |

*Primary Examiner*—Daniel P. Stodola
*Assistant Examiner*—John P. Darling

[57] ABSTRACT

In a web reeling machine such as the reeling portion of a paper machine the successful introduction of a fresh reel bar to maintain the continuity of the reeling operation is dependent upon turn-up of the web onto the rotating reel bar followed by build-up of a roll on the reel. The end of a bifurcated fiber optic cable is positioned adjacent the jaw clamps that retain the stationary end bearings of the reel bar so as to provide an indication of the occurrence of successful turn-up by detecting a persevering change in the clamp/bearing relationship due to roll growth. The other end of the bifurcated cable is connected to an light emitter and a light detector. The light emitter generates a light signal along the bifurcated fiber optic cable towards a light guide path in a jaw clamp so that the light signal passes through the light guide path. When the jaw clamp moves, the light guide path moves and the jaw clamp reflects the light signal back toward the bifurcated fiber optic cable which transmits the reflected signal to a light detector which detects the change in reel bar location due to roll growth. The system can tolerate motion inconsistencies caused by reel bar bounce, due to a rough turn-up of the web.

12 Claims, 1 Drawing Sheet

DETECTION APPARATUS FOR PAPER BUILD UP ON REEL BAR

FIELD OF THE INVENTION

The present invention is directed to a detection apparatus for detecting successful turn-up of a web onto a reel bar in a winding machine. In particular, the invention is directed to such a detection apparatus utilizing an optical signal generator and an optical sensor.

BACKGROUND OF THE INVENTION

In the operation of paper machines, which continuously produce a paper web of great width, travelling at speeds in the range of about 2000 to 4000 feet per minute, the economic operation of the process is dependent on successfully reeling newly formed pressed and dried paper web onto reel bars to provide large paper rolls. These rolls are thereafter removed from the paper making machine for further processing into paper product.

Successful reeling or winding is frequently effected in modern paper machines by using an auto loader such as disclosed in Applicant's U.S. Pat. No. 4,744,720 issued May 17, 1988. The auto loader contains empty reel bars in stored relation above the reeling station. The reel is lowered downwardly when required into a location above the travelling paper web to receive and take up the severed end of the web. The web is turned up towards the spinning reel bar as the preceding formed paper roll is severed and removed.

Such operations involve displacement of an empty reel bar into an initial reeling position with respective end bearings of the reel bar secured within a bearing end clamp arrangement. Upon severance of the moving paper web from a previously formed roll located in a second reeling position spaced from the initial reeling position of a new reel bar, the new rotating reel bar, running in contacting relation with the reel driving drum contacts the released web, and turn-up of the web free end occurs. That is to say, the free end of the severed web makes adhering contact with the surface of the new reel bar and a new roll commences formation.

If web turn-up is achieved successfully, the reel bar bearing end clamps may be released, permitting a reel handling mechanism to move the partially loaded reel bar to the second, reel locating station, for completion of roll formation.

It is the detection of completed web turn-up to which the present invention is directed.

The reliable detection of changes in reel bar position is complicated by machine vibration and possible bouncing of the reel bar, which may occur when there is a rough turn-up, so that roll formation does not proceed smoothly.

In one prior paper web handling arrangement mechanical feelers have been used in an effort to track the axial location of reel bar bearings. An example of such use may be found in U.S. Pat. No. 4,358,066 issued Nov. 9, 1982 to Deutschle et al. The use of light in a position sensing mechanism is shown in U.S. Pat. No. 4,762,292 issued Aug. 9, 1988 to D'Anci, in relation to a narrow recording tape, using reflective beads. Light sensors also are used in controlling a paper reeling operation, as shown in U.S. Pat. No. 4,267,752 issued May 19, 1981 to Byrt et al wherein sensor signals are used to control reeling tension.

U.S. Pat. No. 4,131,206 issued Dec. 26, 1978 to Kawada et al although directed to the printing industry is of interest, in that it relates to the large mass of wound paper rolls, operating at like speeds to that of a paper machine, and demonstrates the criticality of correct timing in their handling.

SUMMARY OF THE INVENTION

The present invention provides a detection system for detecting successful turn-up of web onto a reel bar in a paper machine. The paper machine has securing means engaging the reel bar for holding the reel bar in an initial winding position until a predetermined amount of web has been wound onto the reel bar. The detection apparatus includes an optical sensor mounted to a stationary portion of the machine for detecting a change in state of an optical signal. The change of state is indicative of a change in the presence and absence of the optical signal. The detection apparatus further includes an optical signalling means mounted to the securing means for changing the state of the optical signal when the securing means moves a predetermined distance due to build up of paper on the reel bar. The detection apparatus further includes control means connected to the output of the optical signal detector for generating a signal indicating successful turn-up of winding of the web onto the reel bar upon the change of state continuing for a predetermined period of time.

In one embodiment, it is envisaged that the optical signalling means includes a light source and a light transmission path optically connecting the source to the optical sensor. A portion of the path is subject to change in its light transmitting state upon the occurrence of a predetermined extent of relative displacement between the securing means and the stationary portion of the paper machine.

The detection apparatus may include time delay means to provide a time delay of predetermined duration between the occurrence of a change in the optical light signal.

In the preferred embodiment the predetermined time delay slightly exceeds the cycle time for positional disturbance of the reel bar clamp system arising from the bouncing of a reel bar secured in the mechanism, such as on the occurrence of a rough turn-up of a web onto the subject reel bar.

It will be understood that the time delay means may be utilized in order to allow for many phenomena. In the preferred embodiment the phenomena are transitory in nature, having a cycle time of predetermined value, which time of disturbance is exceeded by the time delay provided by the system.

The subject detection apparatus incorporates a light transmission path, associated with the reel bar securing clamp, having a predetermined extent of acceptable lateral misalignment such that relative displacement between the securing means and the stationary portion of the machine provides a predetermined extent of acceptable lateral misalignment without effecting disruption of the light transmission path sufficient to actuate control means.

In one embodiment the light transmission path includes an orifice of predetermined size, the selected size thereof determining the extent of lateral misalignment that can occur without the occurrence of a successful turn-up signal.

While the orifice size may be determined by a hole of selected diameter drilled laterally through one of the two relatively moveable mechanism portions, an adjustable orifice may be readily provided, having a selectively slotted plate, wherein a selected portion of the slot constitutes the orifice, or a portion thereof.

A bifurcated fiber optic cable preferably optically couples the light sensor, the light generator and the control means. In the environment of a paper making machine, which may be subject to vibration, heat and high humidity the provision of a flexible, cable-like fibre optic guide permits location of other components of the system in more suitable environments. Thus, susceptible electronic or other components may be located both with a view to minimizing environmental hazard and optimizing accessibility thereof, for servicing.

In the preferred embodiment of the present invention the reel bar handling mechanism transfers the reel bar, upon completion of successful web turn-up in winding relation on the reel bar, from a first position high in the winder, where turn-up is accomplished, to a second position substantially displaced 90 degrees from the turn-up position, for completion of the winding of the roll onto the reel bar. This then facilitates ready removal of the completed roll and deployment of a fresh reel bar for the succeeding cycle.

The detection of a successful turn-up, by the subject system may be utilized as an enabling signal for initiating transfer of the started roll and its reel bar from the first turn-up position to the succeeding roll completion position.

In the use of the detection apparatus in a reeling paper machine, the optical signalling means may comprise an indicator bracket attached to one of the reel bar bearing clamps and having an orifice in the bracket adjacent the optical sensor which in turn is connected by a bracket to a stationary portion of the machine.

In contrast with systems employing mechanical feelers wherein the feeler components require to be constructed sufficiently massively to be damage proof and wear-resistant, the subject detection system has no moving parts per se, and is less vulnerable to damage.

BRIEF DESCRIPTION OF THE DRAWINGS

Certain embodiments of the invention are described by way of example, without limitation of the invention thereto, reference being made to the accompanying drawings, wherein.

DETAILED DESCRIPTION OF THE INVENTION

Figure 2:
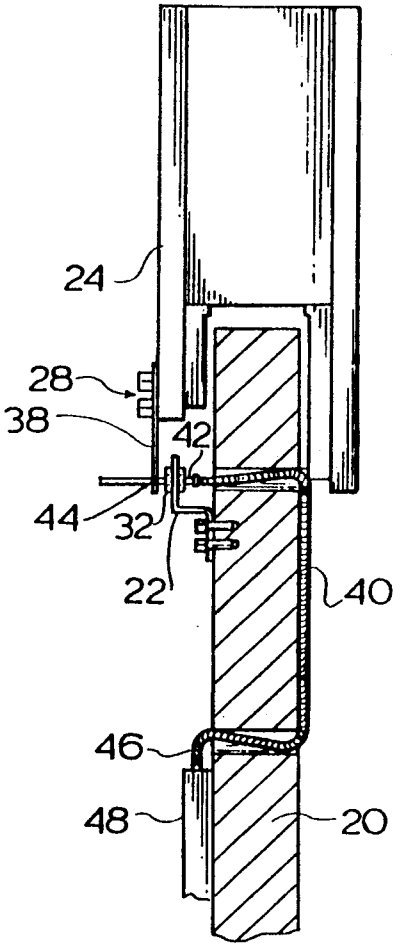
Figure 1:
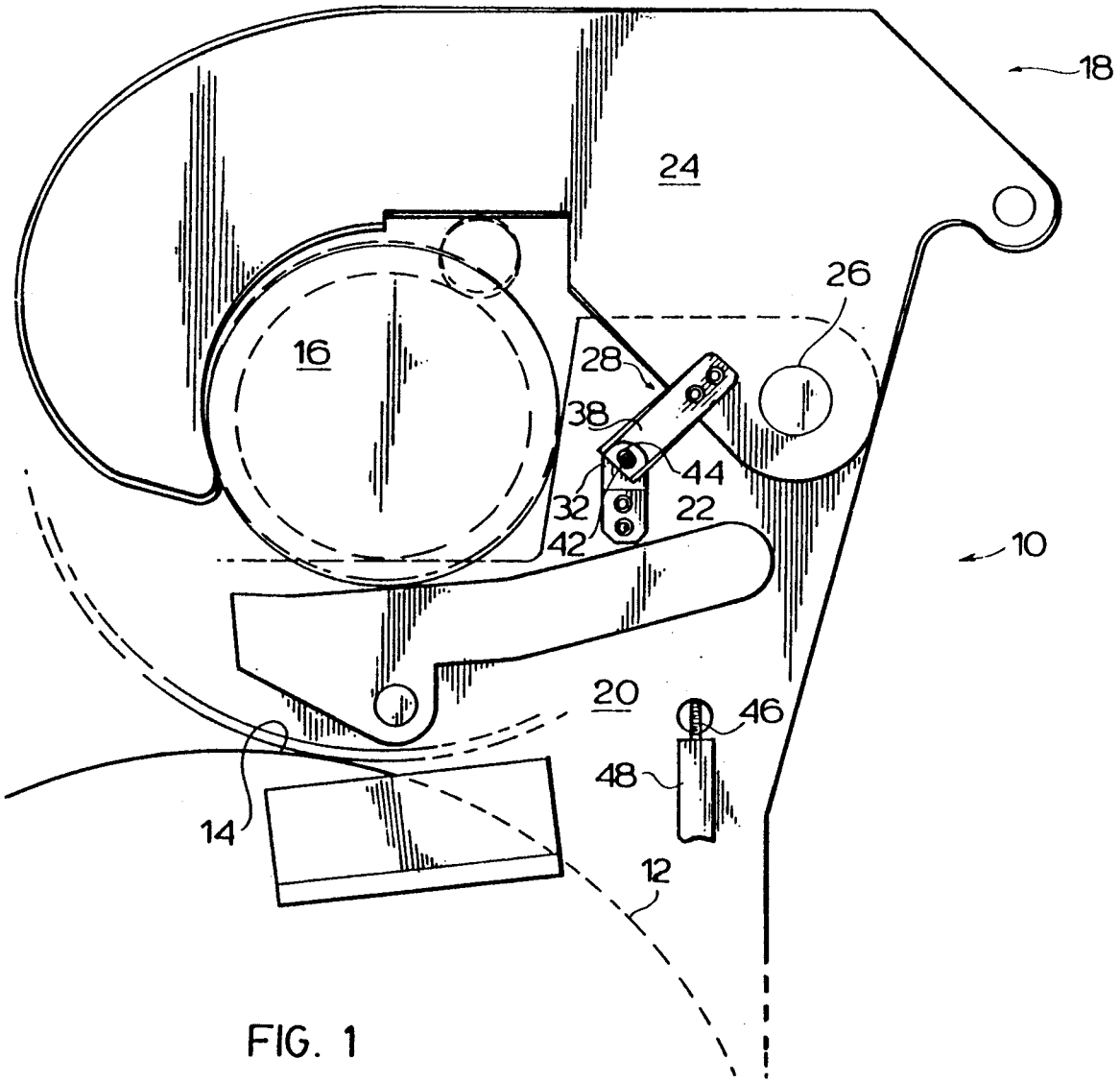
FIG. 1 is a side elevation showing a portion of a reeling mechanism having a reel bar bearing clamp incorporating a detector in accordance with the present invention; and, FIG. 2 is a schematic side sectional view of FIG. 1.

Referring to FIGS. 1 and 2, the reel arrangement 10 shows a portion of a reel drive drum 12 in driving contact with a portion of reel bar 14 during web turn-up in the reeling operation in the web turn-up location. Each of the two reel bar end bearings 16 is secured in a securing means or clamp arrangement 18. The clamp arrangement 18 is carried upon a clamp support arm 20.

A first bracket portion 22 of the detecting apparatus in accordance with the present invention is secured to the support arm 20.

A clamp jaw portion 24 is pivotally secured at pivot 26 to the support arm 20. The jaw portion 24 has a second bracket portion 28 secured thereto.

An end portion 32 of bracket 22 is positioned in axial overlying relation and juxtaposed to end portion 38 of bracket 28.

A bifurcated fibre optic cable 40 is secured in protected relation inside the clamp support arm 20. The fiber optic cable 40 has one end 42 connected to the end portion 32 of bracket 22 such that the end 42 is in signal transmitting and receiving or optical communication with an aperture 44 in the end portion 38 of bracket 28.

The other end 46 of fiber optic cable 40 is connected remotely from the bracket 22 to a light emitter and light detector positioned within a control means or photoswitch 48. The bifurcated fiber optic cable has two parallel light paths. Along the first light path a light signal is transmitted from the light emitter to end 42 so as to illuminate aperture 44. In the position shown in FIGS. 1 and 2 light emitted from end 42 of cable 40 passes through the aperture 44 when the aperture 44 is in axially aligned relation with the end 42 of fiber optic cable 40. As paper is successfully wound onto reel bar 14, clamp 24 moves upwardly moving aperture 44 in end portion 38 of bracket 28 out of alignment with the end 42 of optical cable 40. Upon slight misalignment, the end portion 38 reflects the light signal back toward the end 42 of the fiber cable. This results in the light signal returning along the other parallel path of the cable 40 to the photodetector located in the control means 48. Upon continued detection of the reflected signal the control means generates a signal indicative of successful winding of the paper onto the reel bar 14.

The size selected for aperture 44 determines the permissible latitude in relative displacement between the aperture 44 and the fiber optic cable 42 prior to the photodetector detecting a predetermined change in the intensity of light detected.

The photodetector is provided with a time delay, having a typical delay period in the order of 2-seconds, so that changes due to intensity of light transitory relative motion of the brackets 22 and 28 occurring as a consequence of the reel bar 14 bouncing on drive roll 12 will not activate the photo-switch 48.

Upon being activated for a period in excess of the delay period, the control means 48 enables the circuit of the succeeding phase of operation of the reeling device, so that the bearing clamp jaws carries the reel bar 14 and its associated roll can travel anti-clockwise about the periphery of drive roll 12 to a second reeling position.

What I claim as new and desire to secure by Letters Patent of the United States of America is:

1. A paper machine for winding a web onto a reel bar including:

loading means for moving the reel bar into a first winding position to engage a drive drum and to initiate winding of a web onto the reel bar;

securing means engaging the reel bar for holding the reel bar in engagement with the drive drum in the first winding position until a predetermined amount of web has been wound onto the reel bar, and thereafter the securing means being moveable remotely of the reel bar to permit the reel bar to be transferred into a second winding position;

detection apparatus for detecting successful turn-up of the web onto a reel bar comprising:

a first bracket mounted to a stationary portion of the machine and having a bracket end portion that carries an optical sensor for detecting a change in state of an optical signal which is indicative of a change in the presence and absence of the optical signal, a second bracket mounted to the securing means including an optical signalling means in the form of an orifice normally axially aligned juxtaposed to the optical sensor for changing the state of the optical signal when said securing means moves a predetermined distance causing the orifice to move out of alignment with the optical sensor due to build up of paper on the reel bar; and, control means connected to the output of the optical signal detector for generating a signal indicating successful turn-up of winding of the web onto the reel bar upon the change of state continuing for a predetermined period of time exceeds the disturbance cycle time of a bouncing reel bar.

2. The machine as set forth in claim 1, said control means including time delay means for provide a delay for said predetermined period of time.

3. The machine as set forth in claim 1, said optical signalling means permits for the optical signal to travel along a light transmission path having a predetermined extent of acceptable lateral misalignment tolerance, wherein relative displacement between the securing means and the stationary portion of the machine can occur without a change in state of the optical signal.

4. The machine as set forth in claim 3, said orifice is of predetermined size, the selected size thereof determining said acceptable misalignment.

5. The machine as set forth in claim 1, said securing means includes a reel bar bearing clamp.

6. The machine as set forth in claim 1 further including light emitting means wherein the optical sensor and light emitting means are positioned remotely of the securing means, a bifurcated optical fiber cable extending from the optical sensor and light emitting means to a position adjacent the securing means for transmitting light generated by the light emitting means to the optical signalling means positioned on the securing means and for returning the optical signal to the optical sensor.

7. A detection apparatus for detecting successful turn-up a web onto a reel bar in a paper machine, the machine having securing means engaging the reel bar for holding the reel bar in an initial winding position until a predetermined amount of web has been wound onto the reel bar, said detection apparatus comprising:

a first bracket mounted to a stationary portion of the machine and having a bracket end portion that carries an optical sensor for detecting a change in state of an optical signal which is indicative of a change in the presence and absence of the optical signal, a second bracket mounted to the securing means including an optical signalling means in the form of an orifice normally axially aligned juxtaposed to the optical sensor for changing the state of the optical signal when said securing means moves a predetermined distance causing the orifice to move out of alignment with the optical sensor due to build up of paper on the reel bar; and, control means connected to the output of the optical signal detector for generating a signal indicating successful turn-up of winding of the web onto the reel bar upon the change of state continuing for a predetermined period of time exceeds the disturbance cycle time of a bouncing reel bar.

8. The apparatus as set forth in claim 7, said control means including time delay means to provide a delay for said predetermined period of time.

9. The apparatus as set forth in claim 8, said optical signalling means permits for the optical signal to travel along a light transmission path having a predetermined extent of acceptable lateral misalignment tolerance, wherein relative displacement between the securing means and the stationary portion of the apparatus can occur without a change in state of the optical signal.

10. The machine as set forth in claim 9, said orifice is of predetermined size, the selected size thereof determining said acceptable misalignment.

11. The apparatus as set forth in claim 7, said securing means includes a reel bar bearing clamp.

12. The machine as set forth in claim 7 further including light emitting means wherein the optical sensor and light emitting means are positioned remotely of the securing means, a bifurcated optical fiber cable extending from the optical sensor and light emitting means to a position adjacent the securing means for transmitting light generated by the light emitting means to the optical signalling means positioned on the securing means and for returning the optical signal to the optical sensor.

* * * * *